United States Patent [19]

Brockelsby et al.

[11] 4,109,869

[45] Aug. 29, 1978

[54] OILER WITH ADJUSTABLE SPRAY NOZZLE

[75] Inventors: Norman D. Brockelsby, Grand Island; Reinhold A. Haase, Hastings, both of Nebr.

[73] Assignee: Dutton-Lainson Company, Hastings, Nebr.

[21] Appl. No.: 807,255

[22] Filed: Jun. 16, 1977

[51] Int. Cl.[2] ..... B05B 1/12

[52] U.S. Cl. ..... 239/491; 239/333

[58] Field of Search ..... 239/333, 490, 491, 493, 239/494

[56] References Cited

U.S. PATENT DOCUMENTS

| | | | |
|---|---|---|---|
| 2,319,767 | 5/1943 | Murphy | 239/491 |
| 3,664,556 | 5/1972 | Perry et al. | 222/385 |
| 3,685,739 | 8/1972 | Vanier | 239/333 |
| 3,701,478 | 10/1972 | Tada | 239/526 X |

*Primary Examiner*—Robert W. Saifer

*Attorney, Agent, or Firm*—Allegretti, Newitt, Witcoff & McAndrews

[57] ABSTRACT

An improved oiler includes a manually operated pump mechanism retained within the oiler container for pumping low viscosity oil and similar low viscosity fluids through a spout of the oiler for discharge by an adjustable spray nozzle. The nozzle is comprised of four separate interengaging parts including a compression fitting which contains a nozzle disc and a channel member. By rotating the compression fitting, physical separation of the disc and channel member is controlled and the pattern of spray through the nozzle is adjusted between a fine spray and a fine stream.

1 Claim, 7 Drawing Figures

OILER WITH ADJUSTABLE SPRAY NOZZLE

BACKGROUND OF THE INVENTION

This invention relates to an improved oiler construction and more particularly to an oiler in combination with a nozzle having a variable spray pattern. Oilers are commonly used for dispensing lubricating oil on machinery. Generally, oilers, particularly hand pump oilers, include a discharge spout with a small orifice or opening through which the oil is pumped. A typical oiler of this type is disclosed in U.S. Pat. No. 3,664,556 which is incorporated herewith by reference. Most oiler applications require that the discharge orifice or opening provide a fine stream or drops of lubricating fluid to be discharged therefrom. With such an orifice, it is then possible to fill oil cups and otherwise dispense the oil by pumping the hand oiler.

Some applications, however, require that a fine mist of oil be provided. For example, lubrication of a large bearing surface may require application of an oil film or mist over the surface of the bearing. In such instances, discharge of a line of spray from the oiler orifice is not acceptable. To provide a fine mist, it is therefore often necessary to change the spout construction of the oiler. This can be accomplished by providing a special nozzle attachment which alters the orifice size and shape.

It is desirable, however, to provide an oiler nozzle construction which by a simple manual adjustment can provide a stream or line of oil discharge as well as a mist spray of any desired pattern. Such a nozzle then need not be replaced to change the oil spray pattern.

In the past, adjustable nozzles have been suggested for use in household spray devices for spraying water and water base solutions such as cleaners. U.S. Pat. No. 3,701,478 typifies such spray containers. It is noted, however, that such prior art does not appear to contemplate use of such nozzles for oilers or in combination with a spray device having a pump mechanism within the liquid storage containers. The prior art devices are not useful with hydrocarbon materials such as oils, solvents, etc. because the container, pump mechanism or nozzle structure may tend to deteriorate. The present invention is an effort to combine and improve upon selective pattern spray nozzles and oilers of the type shown in the prior art referenced. Thus, the structure of the present invention may be manufactured from materials which do not deteriorate in a hydrocarbon environment.

SUMMARY OF THE INVENTION

The invention relates to the combination of an oiler including an oil can with a top, a spout and a mechanical hand pump with a variable pattern spray discharge nozzle. The variable pattern spray nozzle has four component parts including a mounting member to attach the nozzle to the spout of the oil spray can. The internal operating parts of the variable spray nozzle are positioned in a compression fitting and include a channel member which cooperates with a disc. The compression fitting is attached to the mounting member and operates to control separation of the channel member and disc which, in turn, controls the spray pattern through the nozzle.

It is thus an object of the present invention to provide an improved oiler of the type including a mechanical hand pump in combination with a variable spray nozzle.

A further object of the present invention is to provide an oiler construction having a variable spray nozzle wherein the nozzle may be adjusted to provide a fine line or stream of fluid as well as a mist.

Still a further object of the present invention is to provide a variable spray nozzle in combination with an oiler wherein the nozzle construction may be incorporated with oilers of the type previously known in the art.

Another object of the invention is to provide an oiler spray nozzle which is especially useful for controlling the spray pattern of low viscosity fluids including light oils, solvents, silicone compounds and the like.

One further object of the present invention is to provide a nozzle construction in combination with a hand pump oiler which is easy to use, economical to manufacture and easy to replace on the spout of the oiler.

These and other objects, advantages and features of the invention will be set forth in greater detail in the description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
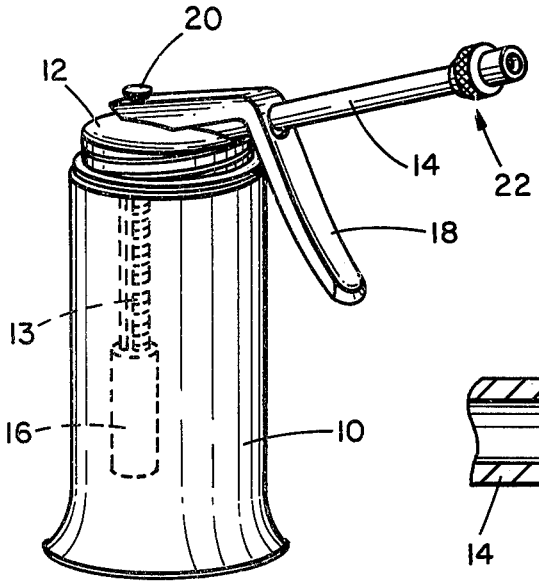
FIG. 1 is a perspective view of the improved oiler combination of the present invention.
Figure 2:
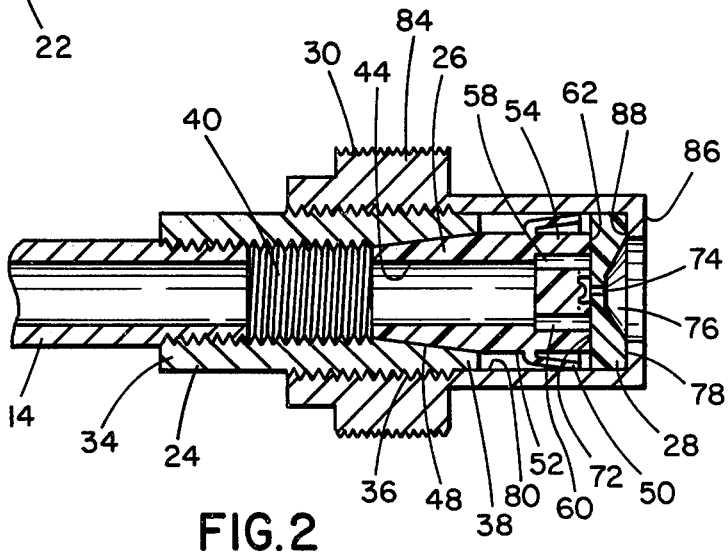
FIG. 2 is a cross-sectional view of the assembled oiler spray nozzle of the present invention.
Figure 3:
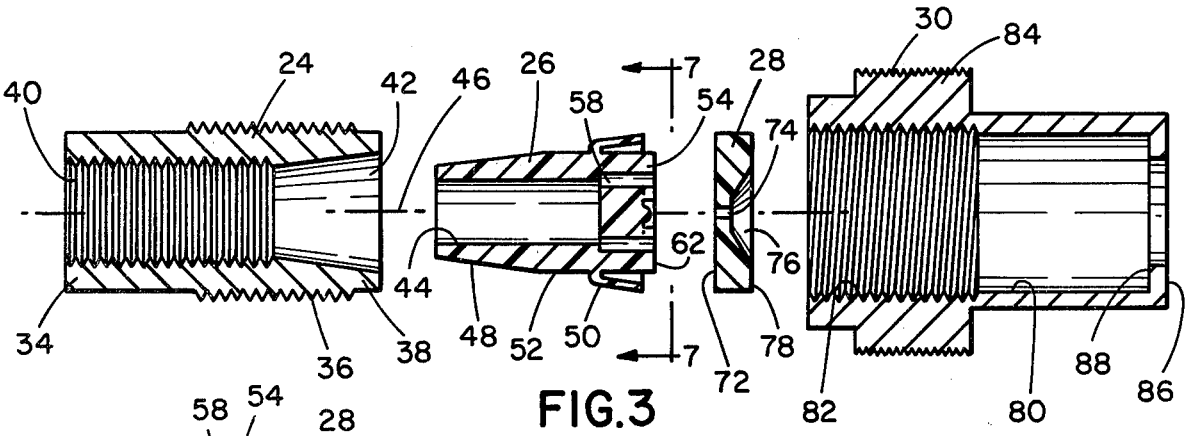
FIG. 3 is an exploded cross-sectional view of the spray nozzle of FIG. 2.

Referring to the FIGURES, FIG. 1 illustrates a typical oiler. The oiler of FIG. 1 includes an oil can 10 with a removable screw top 12. A substantially uniform diameter tube 13 including a discharge spout 14 extends through the top 12 to the interior of the can 10. Within the can 10 at the inside end of tube 13 is a pump 16 as shown in phantom in FIG. 1. A pivotal external handle 18 which is manually operable cooperates with a linkage 20. Manual actuation of the handle 18 of the linkage 20 operates the pump 16 to pump liquid material from within the can 10 through the spout 14. The oiler of FIG. 1 is substantially the same as the oiler disclosed in U.S. Pat. No. 3,664,556 which is incorporated herewith by reference.

Attached at the end of spout 14 is a variable spray nozzle 22. The subject matter of the invention comprises the combination of the improved nozzle 22 with an oil can structure of the type previously described.

Referring to FIGS. 2 through 7 therefore, variable spray nozzle 22 is illustrated in greater detail. The end of spout 14 is threaded to receive the nozzle 22. The nozzle 22 includes a mounting member 24 within which is mounted a channel member 26 and a disc 28. The channel member and disc are held in position in cooperation with the mounting member 24 by means of a compression fitting 30.

The mounting member 24 is annular and includes an outside surface of an inner end 34 which may be knurled to facilitate placement of the nozzle 22 on the spout 14. Outside surface 36 of the outer end 38, is threaded to receive the compression fitting 30. An inner passage 40 through the mounting member 24 is threaded at the inner end 34 and includes an outwardly diverging frustoconical surface 42 at the outer end 38.

The channel member 26 is also generally annular and is partially closed at its forward end 54. Member 26 includes a center passage 44 concentric about a centerline axis 46 for nozzle 22. The outside surface of inner end 48 of channel member 26 is frustoconically shaped so that end 48 is compatible with and snuggly engages the surface 42 of mounting member 24.

Figure 7:
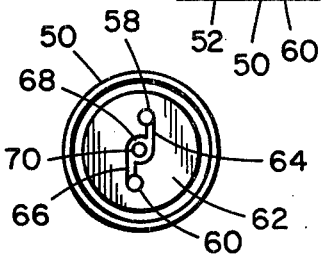
FIG. 7 is a cross-sectional view of the spray nozzle channel member as viewed along the line 7—7 in FIG. 3.

A circumferential lip seal 50 is provided on the outside surface 52 of channel member 26. The forward or outer end 54 includes an integral block 56 which blocks passage 44. First and second parallel openings 58 and 60 extend through the block 56 from passage 44 to a flat face 62. As shown in FIG. 7, the openings 58 and 60 connect with channels 64 and 66 respectively in the flat face 62. The channels 64 and 66 extend substantially radially from a circular depression 68 in face 62. Depression 68 lies on the centerline axis 46. A hub projection 70 extends upward toward the flat face from the bottom center of the circular depression 68. The hub 70 extends only slightly below or back of the plane of the flat face 62.

Flat disc 28 includes a back surface 72 which may fit against the flat face 62. A centerline opening or passage 74 extends on the centerline 46 through the disc 48. The cross sectional area of passage 74 is substantially less than that of the openings 58 and 60. In the embodiment shown, the cross-sectional area of passage 74 is about one-fourth ($\frac{1}{4}$) that of openings 58 and 60. A frustoconical depression 76 is defined at the outside face 78 of disc 28 to permit exit of the spray pattern.

The compression fitting 30 has an inner cylindrical chamber 80. The lip seal 50 cooperates with the smooth sides of chamber 80. The inner end 82 of the chamber 80 is threaded so that the compression fitting 30 cooperates with threaded outside surface 36 of mounting member 24. A knurled outside rib 84 of fitting 30 facilitates rotation of the fitting 30. Outside end 86 of fitting 30 includes an inwardly projecting flange 88 which cooperatively engages the outside surface 78 of disc 28.

The structure having been described operates in the following manner. The channel member 26 is a press fit into mounting member 24 and disc 28 is a press fit into compression fitting 30. As the compression fitting 30 is threaded upon the mounting member 24, the disc 28 is retained in a desired spaced relation from channel member 26. The amount of space between faces 62 and 72 is variable between the extremes exemplified by FIGS. 4 and 6.

Figure 4:
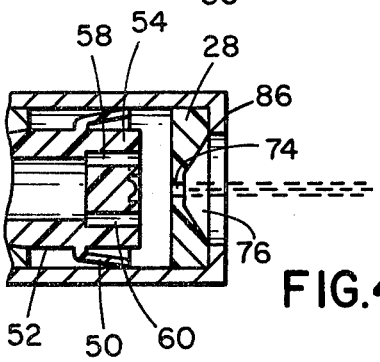
FIG. 4 is a cross-sectional view of the spray nozzle illustrating a fine line spray discharge.

In FIG. 4, the disc 28 is spaced a sufficient distance from the channel member 26 to permit formation of a fine line or stream of fluid from the nozzle. As a result, the path of fluid through passage 44, openings 58 and 60, channels 64 and 66 and openings 74 is fairly unrestricted.

Figure 6:
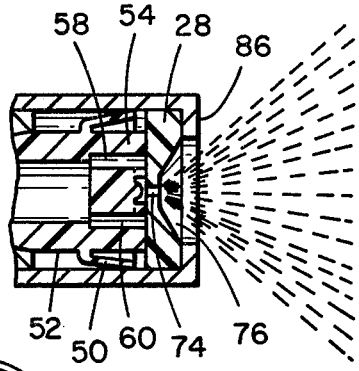
FIG. 6 is a cross-sectional view of the nozzle similar to FIGS. 4 and 5 wherein the nozzle has been adjusted to provide a fine mist spray.

In FIG. 6, a fine mist spray pattern is achieved when the channel member 26 and disc 28 are in contact with one another at surfaces 62 and 72. This requires that the fluid travels through channels 64 and 66 and enters depression 68 before exiting through the orifice 74. The shape of the channels 64, 66 and depression 68 impart angular momentum (a spinning or swirling action) to the fluid. This angular momentum is retained by the fluid through the relatively short length of the orifice 74 and causes the fluid to fan out in a spray pattern when it exists from the orifice 74.

Figure 5:
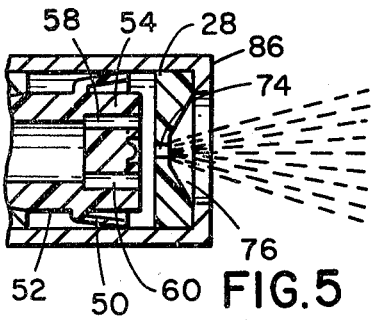
FIG. 5 is a cross-sectional view similar to FIG. 4 wherein the nozzle has been adjusted to provide for a partial mist spray.

When the compression fitting 30 is turned to the position shown in FIG. 5, so that there is a small space between the channel member 26 and disc 28, only a portion of the fluid travels through channels 64 and 66 and thereby the amount of angular momentum given to the fluid is reduced and the size of the spray pattern is reduced. When the space between the channel member 26 and disc 28 is relatively large, the fluid receives no angular momentum and therefore exits in a straight stream as described above relative to FIG. 4.

As previously described, the orifice is relatively small in comparison to the openings 58, 60. This is important and insures that the velocity of the fluid is increased as it passes through channels 64 and 66. It is important that adequate velocity be generated in these channels 64, 66 so that sufficient angular momentum is generated in depression 68 to form a mist. There are several reasons for the channel member 26 and disc 28 being constructed from plastic and thus being slightly compressible. The plastic parts permit a tight leak free fit between the disc 28 and the compression fitting 30 and between the channel member 26 and mounting member 24. Also, the circumferential lip seal 50 of channel member 26 is slightly compressible so that it maintains a tight leak free fit with the inside of the compression fitting 30.

The discharge of low viscosity hydrocarbon compounds such as fine lubricating oil is possible. Additionally, other low viscosity fluids can be discharged through the nozzle. Discharge of oil with a broad range of spray patterns is now possible without removing and the replacing the nozzle. A fine mist spray pattern is provided for applications as discussed previously. In addition to the mist spray pattern, a very fine stream may be provided. The solid stream which is produced from this oiler is much finer and much longer than that produced by conventional oilers, thereby allowing very accurate placement of lubricant in otherwise unreachable locations. As a result, the oiler has many uses.

While there has been set forth a preferred embodiment, it is to be understood that the invention shall be limited only by the following claims and their equivalents.

What is claimed is:

1. An improved oiler comprising, in combination:

an oil can;

a removable top;

a substantially uniform diameter tube leading from inside the can and terminating in a spout outside the can, said tube having a pump mechanism incorporated at the end of the tube inside the can, said tube being mounted in the top;

a pump handle also mounted on the top and connected by a linkage to the pump for driving the pump in response to actuation of the handle; and a variable spray nozzle attached to the outside end of the spout, said nozzle including an annular cylindrical mounting member threaded internally for attachment to the end of the spout and threaded externally at the outer end for receipt of a compression fitting, the internal passage of said outer end being frustoconically shaped and diverging outwardly, a cylindrical channel member fabricated from an elastic material, said channel member including a central passage extending partially therethrough from an inside end toward an outside end, the inside end being complementary with the frustoconical portion of the mounting member and press fit therein, the outside end including an integrally molded passage block having an outside flat surface, first and second small diameter openings therethrough, each opening being spaced from the centerline axis of the passage, each opening being connected by a separate channel in the end flat face of the block, said channels intersecting at the centerline axis of the passage to define a depression with a center hub therein, said center hub terminating beneath the plane of the flat face surface, the outside surface including an integral circumferential lip seal projecting therefrom;

a cylindrical disc having a center passage of an area substantially less than the area of the channel member openings, said center passage at the centerline axis of the channel member opposed to the depression and center hub, said disc having a flat inside surface in opposed relation to the flat face of the channel member; and a compression fitting comprising an open ended cylindrical cup with the sealing flange of the channel member engaging the inside surface of the compression fitting, said cylindrical cup threadably attached to the mounting member and including a passage through the bottom of the cup defining an annular flange for retaining the disc and relatively positioning the disc and channel member surface in spaced relation, whereby the compression fitting may be adjusted to adjust the spacing of the disc face relative to the channel member face and thereby provide an adjustable spray pattern, said pattern being a fine line when said face and surface are spaced becoming a mist pattern upon approach and contact of the face and surface in response to the effective increase of the angular momentum of fluid through the channels and depression of the channel member.

* * * * *